US006487977B1

(12) United States Patent
Williams et al.

(10) Patent No.: US 6,487,977 B1
(45) Date of Patent: Dec. 3, 2002

(54) BEACH/OUTDOOR TABLE WITH CORK SCREW ANCHOR AND UMBRELLA

(76) Inventors: Steven Williams, 200 Heritage Rd., North Kingstown, RI (US) 02852; William Smith, 60 Howland Ave., Jamestown, RI (US) 02835

( * ) Notice: Subject to any disclaimer, the term of this patent is extended or adjusted under 35 U.S.C. 154(b) by 0 days.

(21) Appl. No.: 09/906,640

(22) Filed: Jul. 18, 2001

(51) Int. Cl.[7] ..... A47B 37/04; A45B 3/00

(52) U.S. Cl. ..... 108/50.12; 108/150; 108/158; 248/530; 248/545; 135/16; 52/165

(58) Field of Search ..... 135/16; 108/50.12, 108/150, 158; 248/530, 545, 533; 52/165

(56) References Cited

U.S. PATENT DOCUMENTS 888,917 A * 5/1908 Lucas
1,218,357 A * 3/1917 Bauer
2,441,109 A * 5/1948 Carlson
2,607,648 A * 8/1952 Metcalf
2,799,543 A 7/1957 Tomaselli
2,805,109 A * 9/1957 Kopar
3,624,732 A 11/1971 Bowden
3,936,109 A * 2/1976 Richardson
4,461,220 A * 7/1984 Wetzel
4,584,946 A * 4/1986 Tucker et al.
4,850,564 A * 7/1989 Padin
4,920,897 A 5/1990 Reed et al.
5,046,699 A * 9/1991 Perreault et al.
5,152,495 A * 10/1992 Jacinto et al.
5,161,561 A * 11/1992 Jamieson
5,197,394 A 3/1993 Schmidt
D364,048 S 11/1995 Winslow
D366,372 S 1/1996 Skarda
5,540,159 A * 7/1996 Anderson
D388,974 S * 1/1998 Piker
5,762,004 A * 6/1998 Vashon et al.
5,906,077 A * 5/1999 Andiarena
D416,401 S 11/1999 Taylor
6,199,569 B1 * 3/2001 Gibson
6,237,881 B1 * 5/2001 Levesque
6,374,839 B2 * 4/2002 Patarra

* cited by examiner

*Primary Examiner*—Robert Canfield
(74) *Attorney, Agent, or Firm*—Richard C. Litman

(57) ABSTRACT

A portable beach/outdoor table includes a table top adapted to be removably mounted onto the top end of a support pole. An auger is attached to and projects vertically from the lower end of the support pole. A diametrically-extending rod is attached to the support pole adjacent the auger. The rod functions as a wrench to aid in inserting the support pole into the ground. The rod also functions as a stabilizer for the table-mounted support pole.

8 Claims, 3 Drawing Sheets

BEACH/OUTDOOR TABLE WITH CORK SCREW ANCHOR AND UMBRELLA

BACKGROUND OF THE INVENTION

1. Field of the Invention

The present invention generally relates to outdoor furniture. More specifically, the present invention is drawn to a portable, ground-insertable, outdoor table having an attachment for a beach umbrella.

2. Description of the Related Art

Whether in the back yard, at the park or on the beach, it is often desirous to have a small table for holding plates, beverage containers, umbrellas and other outdoor paraphernalia. A small table which is portable, ground-insertable, stable, easily assembled and disassembled would be coveted even more and would certainly be a welcome addition to the art.

The prior art abounds with beach tables having means whereby the table may be inserted in the ground. Examples of which are disclosed in U.S. Pat. No. Des. 364,048 (Winslow, Sr.), 2,799,543 (Tomasaselli), 3,624,732 (Bowden), and 5,197,394 (Schmidt). All of the above patents employ a pole having a pointed end, which end must be forced directly into the ground. Also note that the Patentees do not contemplate providing a structure to enhance the insertion process or provide a stabilizing support for the pole.

U.S. Pat. No. Des. 366,372 (Skarda, Jr.), Des. 416,401 (Taylor) and 4,920,897 (Reed et al.) disclose beach tables having poles with auger structure on the ends thereof. Taylor and Reed et al show narrow flanges for providing stability. The flanges, however, perform no function to aid in inserting the poles into the ground.

None of the above inventions and patents, taken either singularly or in combination, is seen to disclose a portable, ground-inserted outdoor table as will be subsequently described and claimed in the instant invention:

SUMMARY OF THE INVENTION

The present invention is drawn to a portable table which has a myriad of outdoor uses such as at the beach, at backyard cookouts, at picnics in the park, etc. The table comprises a support pole having an externally threaded upper end. The lower end of the pole is provided with an auger or corkscrew member. A diametrically-extending stabilizing rod is attached at the lower end of the pole just above the auger. The support pole can be separated into two pieces at its mid-section. An internally-threaded adjustment knob is utilized to join the two pieces and to also provide a mechanism for adjusting the length of the pole.

A flat disc-shaped member functions as a table top. The table top has an internally-threaded boss extending through the center thereof. On the underside of the table, the boss is threaded to receive the upper end of the support pole. On the top surface of the table, the boss is threaded to receive the threaded end of an umbrella support mast. Convenient cup holders are positioned in the top of the table.

In use, the stabilizing rod is employed as a wrench to aid in screwing the auger end of the support pole into the ground. The rod also functions to bear against the ground and provide stabilizing support for the inserted support pole. Once the support pole has been ground-inserted, the table top may be attached to the upper end of the support pole and the umbrella attached at the upper surface of the table.

As indicated above, the parts are easily assembled and thus, are just as easily disassembled. To enhance storage and portability, a carrying case is provided for receiving the disassembled table parts.

Accordingly, it is a principal object of the invention to provide a portable table adapted to outdoor use.

It is another object of the invention to provide a portable table for outdoor use, which table is supported in the ground in a stable condition.

It is a further object of the invention to provide a portable table having parts which are easily disassembled for storage and transportation.

Still another object of the invention is to provide a portable table having means for housing the disassembled parts of the table.

It is an object of the invention to provide improved elements and arrangements thereof for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
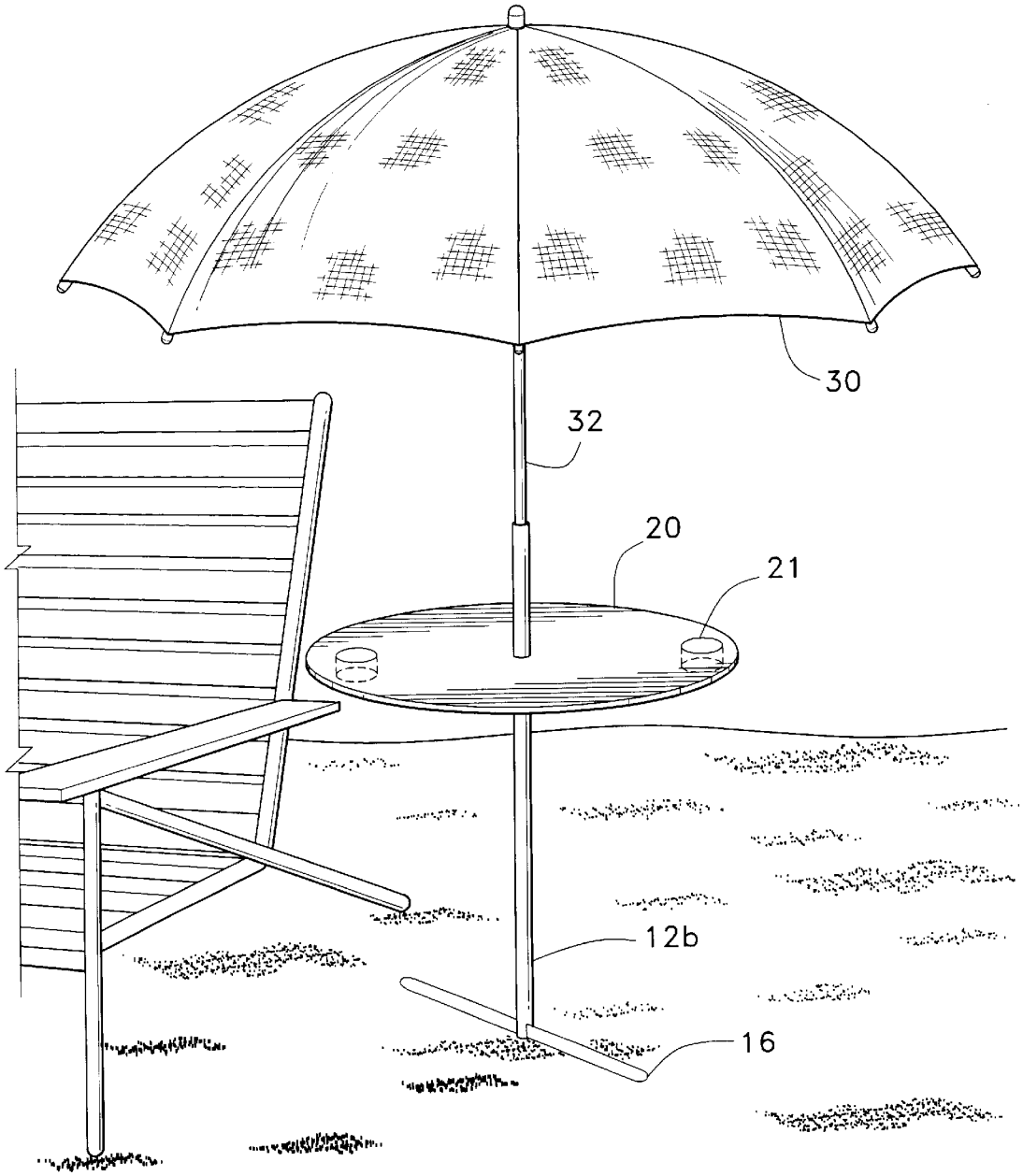
FIG. 1 is an environmental, perspective view of a portable table and umbrella attachment according to the present invention.
Figure 2:
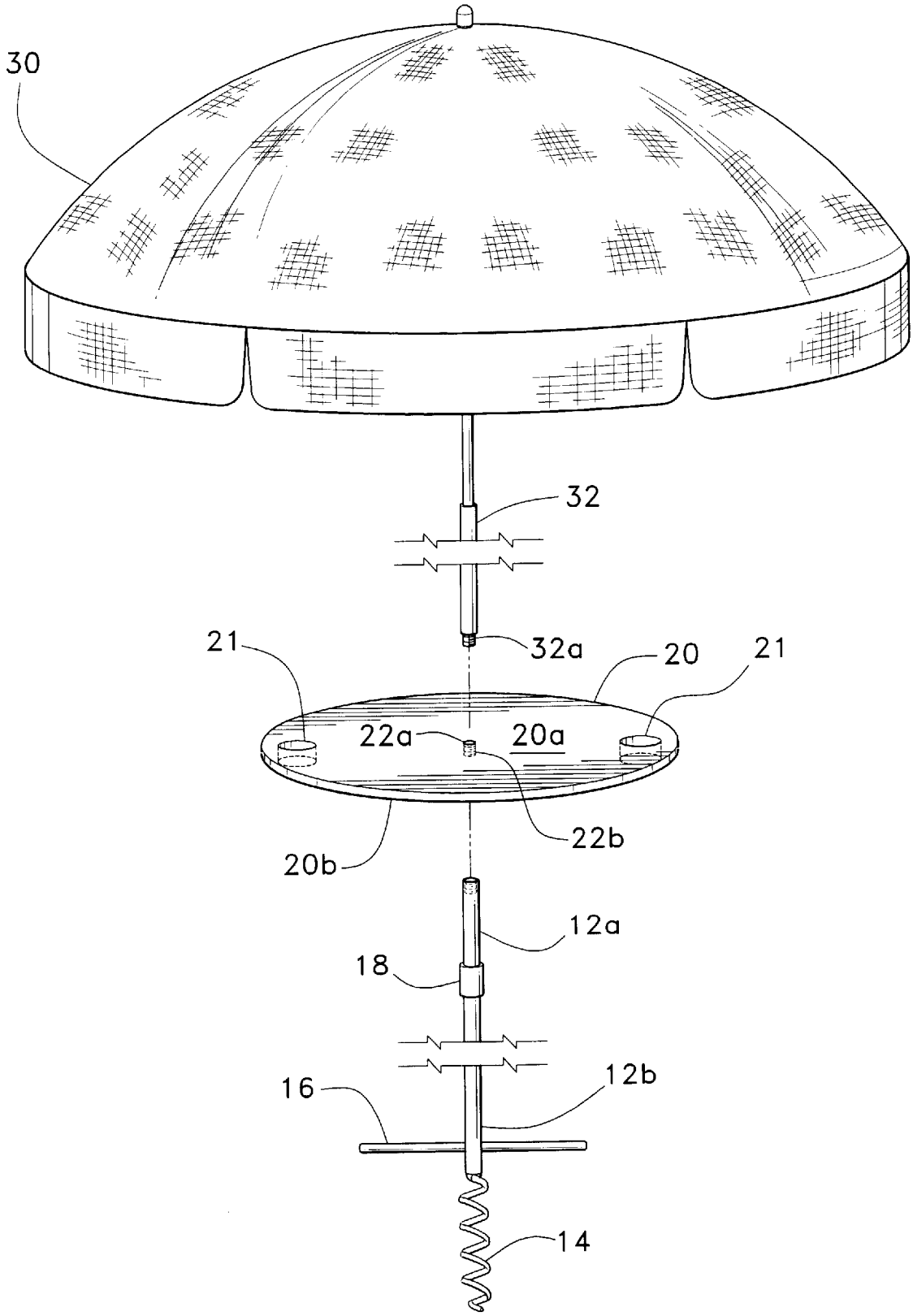
FIG. 2 is an exploded, perspective view of a portable table and umbrella attachment according to the present invention.

The present invention generally indicated at 10, as illustrated in FIGS. 1 and 2, includes a two-piece support pole 12*a*, 12*b*. Upper part 12*a* is externally threaded at both ends (one end shown in phantom lines). Lower part 12*b* is threaded at one end (upper, shown in phantom lines) and is provided with a metal auger 14 at its other end (lower). Auger 14 may be fabricated from any suitable, rust-resistant metal and extends vertically downward from the lower end of lower support pole 12*b*. Support poles 12*a*, 12*b* may be metallic or made from wood or plastic. A stabilizing rod 16 is attached adjacent the lower end of pole 12*b* just above the auger. Rod 16 extends a predetermined distance diametrical to pole 12*b* and perpendicular to augur 14. A conventional internally threaded adjustment knob 18 is utilized to provide connecting means for poles 12*a* and 12*b*. Knob 18 also provides means for adjusting the height of the connected poles.

Table top 20 is configured as a disc having planar top 20*a* and bottom 20*b* faces. Other configurations (square, rectangle) may be utilized but the disc is preferred for safety considerations (no sharp corners). Top 20 is preferably fabricated from a molded plastic. The top surface is provided with convenient cup holders at 21. An internally threaded boss is positioned at the center of top 20. The boss has threaded portions 22*a*, 22*b* respectively projecting on both top and bottom faces of top 20.

A conventional umbrella 30 and umbrella support mast 32 are adapted for attachment to the table top 20. Support mast 32 is externally threaded at its lower end 32*a*.

As indicated above, the parts of the invention are easily assembled merely by screwing the auger end of pole 12*b* into the ground, using rod 16 as a wrench, until rod 16 is flush with the ground. Rod 16 will then function as stabilizing means. The other elements (pole 12*a*, top 20, umbrella 30) are obviously attached via respective elements knob 18 and boss 22.

Figure 3:
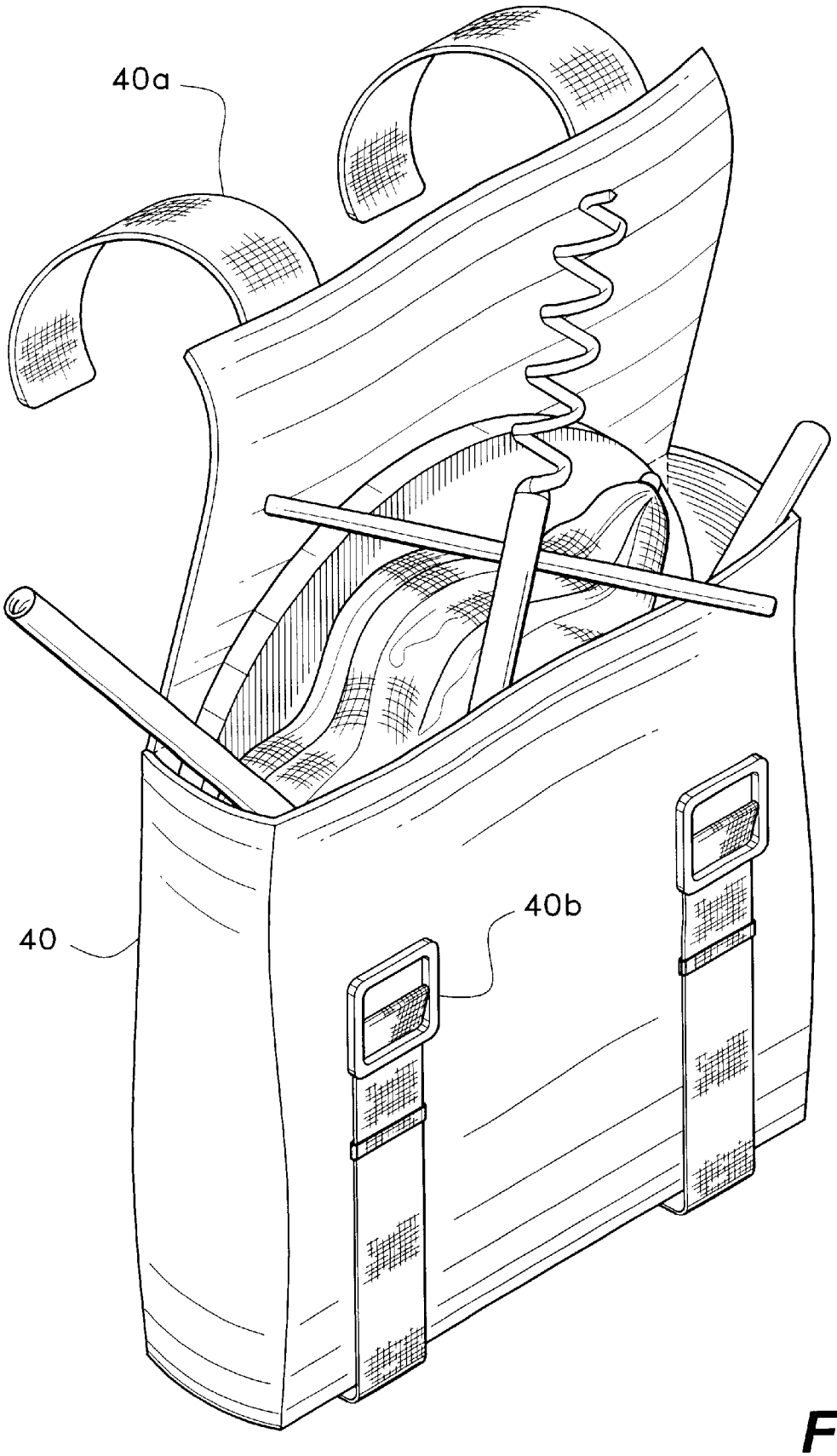
FIG. 3 is a perspective view of a bag for storing and transporting a portable table and umbrella attachment according to the present invention.

To enhance portability, a carrying case 40 (FIG. 3) is provided to house and store the disassembled elements. Case 40 is fabricated from a rugged material (nylon, for example) and is provided with attendant straps 40*a* and fasteners 40*b* to facilitate securing and carrying.

It is to be understood that the present invention is not limited to the embodiment described above, but encompasses any and all embodiments within the scope of the following claims.

We claim:

1. A beach/outdoor table adapted to be supported in the ground, comprising:

an upstanding pole member, said pole member having an upper portion an a lower portion;

said upper portion having an upper end and a lower end;

said lower portion having a first end and a second end;

external screw threads formed on said upper end and said lower end of said upper portion and said first end of said lower portion;

an auger, said auger attached to said second end of said lower portion and extending vertically downward therefrom, whereby said lower portion may be screwed into the ground;

an elongate stabilizing rod, said elongate stabilizing rod attached to said lower portion adjacent said second end and extending diametrically therefrom;

a table top, said table top having a planar top surface and a planar bottom surface;

an internally-threaded boss, said internally-threaded boss disposed in a central area and extending through said table top, whereby said table top may be attached to said upper end of said upper portion; and an internally-threaded adjustment knob, said adjustment knob receiving the lower end of said upper portion and the first end of said lower portion.

2. A beach/outdoor table as recited in claim 1, including an umbrella;

a support mast attached to said umbrella, said support mast having a lower end;

external threads defined on said lower end of said support mast, whereby said support mast can be attached to said internally-threaded boss.

3. A beach/outdoor table as recited in claim 2, wherein said table top is shaped as a disc.

4. A beach/outdoor table as recited in claim 3, wherein said table top is fabricated from molded plastic.

5. A beach/outdoor table as recited in claim 4, including at least one cup holder formed in said planar top surface of said table top.

6. A beach/outdoor table as recited in claim 5, wherein said stabilizing rod is fabricated from a rust-resistant metal.

7. A beach/outdoor table as recited in claim 6, wherein said upstanding pole member is fabricated from materials selected from the group consisting of plastic, wood and metal.

8. A beach/outdoor table as recited in claim 7, wherein said upstanding pole member, said table top and said umbrella comprise separable elements; and a carrying case for housing said separable elements.

* * * * *